US005285643A

United States Patent [19]

Hirata et al.

[11] Patent Number: 5,285,643

[45] Date of Patent: Feb. 15, 1994

[54] HYDRAULIC DRIVE SYSTEM FOR CIVIL-ENGINEERING AND CONSTRUCTION MACHINE

[75] Inventors: Toichi Hirata, Ushiku; Hiroshi Onoue, Ibaraki, both of Japan

[73] Assignee: Hitachi Construction Machinery Co., Ltd., Tokyo, Japan

[21] Appl. No.: 743,295

[22] PCT Filed: Apr. 2, 1990

[86] PCT No.: PCT/JP91/00440

§ 371 Date: Aug. 15, 1991

§ 102(e) Date: Aug. 15, 1991

[87] PCT Pub. No.: WO91/15636

PCT Pub. Date: Oct. 17, 1991

[30] Foreign Application Priority Data

Apr. 2, 1990 [JP] Japan ..... 2-84986

[51] Int. Cl.[5] ..... F16D 31/02

[52] U.S. Cl. ..... 60/468; 60/494

[58] Field of Search ..... 60/459, 463, 464, 466, 60/468, 493, 494

[56] References Cited

U.S. PATENT DOCUMENTS

| | | | |
|---|---|---|---|
| 3,633,359 | 1/1972 | Worn | 60/463 X |
| 4,317,331 | 3/1982 | Aruga et al. | 60/468 X |
| 4,694,647 | 9/1987 | Yoshida | 60/493 X |
| 4,958,494 | 9/1990 | Maki et al. | 60/468 |
| 5,048,294 | 9/1991 | Oshina et al. | 60/468 |
| 5,063,742 | 11/1991 | Yoshimatsu | 60/468 X |
| 5,159,813 | 11/1992 | Yoshimatsu | 60/468 X |

FOREIGN PATENT DOCUMENTS 57-25570 2/1982 Japan .

*Primary Examiner*—Edward K. Look
*Assistant Examiner*—Hoang Nguyen
*Attorney, Agent, or Firm*—Fay, Sharpe, Beall, Fagan, Minnich & McKee

[57] ABSTRACT

A hydraulic drive system for civil-engineering and construction machines has reverse motion check valves and a regulator for selectively limiting outflow of the hydraulic fluid through the reverse-motion check valves. This prevents unusual operation of the valves in certain environments, such as in a low-temperature environment and in an environment where the civil-engineering and construction machine is operated on an incline.

11 Claims, 14 Drawing Sheets

HYDRAULIC DRIVE SYSTEM FOR CIVIL-ENGINEERING AND CONSTRUCTION MACHINE

TECHNICAL FIELD

The present invention relates to hydraulic drive systems for civil-engineering and construction machines, such as hydraulic excavators and the like and, more particularly, to a hydraulic drive system comprising a pair of reverse-motion check valves for preventing a reverse motion of an inertial body from occurring upon stopping halting movement of the inertial body.

BACKGROUND ART

A hydraulic excavator, which is a typical example of a civil-engineering or construction machines, comprises a swing as one of a plurality of working elements. A hydraulic drive system for the swing generally comprises a hydraulic pump constituting a hydraulic-fluid source, a hydraulic motor for driving the swing, a directional control valve for controlling flow of hydraulic fluid supplied from the hydraulic pump to the hydraulic motor, a pair of main lines through which the directional control valve and the hydraulic motor are connected to each other, the pair of main lines serving selectively as a fluid supply line and a fluid return line by switching of the directional control valve, and a pair of relief valves provide respectively in lines through which the pair of main lines are connected to each other. Further, since the swing is an inertial body, it is necessary to brake the hydraulic motor upon halting movement of the swing and, accordingly, brake means utilizing back pressure of the hydraulic motor is incorporated in the hydraulic drive system. The brake means is a counter balance valve arranged in the pair of main lines, for example.

The counter balance valve operates such that the hydraulic fluid is prevented from being returned to a tank from the main lines when the directional control valve is returned to a neutral position in order to halt the swing from a condition under which the swing is driven. When the hydraulic motor tends to be rotated by an inertial force of the swing, the hydraulic fluid is prevented from being returned from the main line on a return side of the hydraulic motor by the counter balance valve. By doing so, a pressure (back pressure) in the main line increases abruptly by a pumping action of the hydraulic motor. When a magnitude of the pressure exceeds a set pressure of a corresponding one of the relief valves, the relief valve is moved to an open position. Thus, the hydraulic fluid is recirculated through a closed circuit composed of the relief valve, the hydraulic motor and the main lines, so that the hydraulic motor is braked.

By the way, in the hydraulic drive system provided with such brake means, there is such a problem that a reverse motion of the inertial body occurs due to the action of the back pressure upon halt of the inertial body.

That is, as described above, the pressure in the main line on the return side of the hydraulic motor increases abruptly to the set pressure of each of the relief valves to brake the hydraulic motor. When the hydraulic motor is halted, however, each of the relief valves is moved to the closed position so that the pressure in the main line is brought to a condition maintained at high pressure. Accordingly, a differential pressure occurs between outlet and inlet ports of the hydraulic motor. The hydraulic motor begins to rotated reversely by the differential pressure. Thus, the differential pressure between the outlet and inlet ports of the hydraulic motor is nullified. However, the hydraulic motor continues to be further rotated in the same direction by the inertial force of the swing. Thus, this time, the pressure in the main line on the reverse side is brought to a high pressure so that a differential pressure occurs across the hydraulic motor. The hydraulic motor again begins to rotate. In this manner, in the case where the brake means utilizing the back pressure is provided, a reverse motion occurs in which the swing is swung a plurality of times, by the inertial force of the swing, in spite of the fact that halt of the swing is intended.

In order to solve the above-described problem, JP,A, 57-25570 has proposed a pair of reverse-motion check valves each of which is connected to a pair of main lines of a hydraulic drive system. Each of the reverse-motion check valves is arranged as follows. That is, a volume chamber is defined between a valve housing and a movable seat against which a poppet is abutted. A small bore for damping is provided through which the hydraulic fluid is returned from the volume chamber. Return speed of the movable seat is slowed or retarded with respect to the poppet by a restricting action of the damping small bore immediately after halt of the hydraulic motor. The poppet and the movable seat are temporarily spaced from each other to move the valve to the open position. A high pressure generated in the main line on the return side of the hydraulic motor is relieved to the other main line. The pressure in the main line on the return side is reduced by the temporary movement of the reverse-motion check valve to the open position. Energy required for the reverse motion of the swing disappears before the reverse-motion check valve is again moved to the closed position. Thus, no reverse motion of the swing occurs.

As described above, each of the reverse-motion check valves disclosed in JP,A, 57-25570 is moved to the open position by utilization of the restricting action of the damping small bore. In the case of a low-temperature environment and in the case where the hydraulic excavator is arranged on a slope, however, there occurs a problem. That is, when the hydraulic fluid is low in temperature, the hydraulic fluid increases in viscosity. Accordingly, the restricting action of the damping small bore increases so that the return speed of the movable seat is retarded. Thus, a condition under which the reverse-motion check valve is opened continues long. Accordingly, in the case where any one of the pair of main lines is brought to a high pressure accompanied with halt operation of the swing, the reverse-motion check valve continues, for a relatively long time, the condition under which the reverse-motion check valve is opened as described above. Accordingly, the hydraulic fluid in one of the main lines flows into the opposite main line so that a swing motor is rotated abnormally contrary to intention. After all, there occurs such a situation that the swing is rotated transiently. Such transient rotation reduces working efficiency and, in addition thereto, reduces safety so that operability is considerably impeded.

It is an object of the invention to provide a hydraulic drive system for a civil-engineering and construction machine, capable of preventing a reverse motion of an inertial body upon halt of an actuator, and capable of ensuring that the actuator is halted without being accompanied with abnormal operation at low-temperature environment and when the civil-engineering and construction machine is arranged on a slope to conduct operation.

DISCLOSURE OF THE INVENTION

For the above purposes, according to the invention, there is provided a hydraulic drive system for a civil-engineering and construction machine, comprising a hydraulic-fluid source, an actuator operated by hydraulic fluid supplied from the hydraulic-fluid source for driving an inertial body, a directional control valve for controlling flow of the hydraulic fluid supplied from the hydraulic-fluid source to the actuator, a pair of main lines through which the directional control valve and the actuator are connected to each other, the pair of main lines functioning selectively as a main line on a fluid supply side and a main line on a fluid return side by operation of the directional control valve, and reverse-motion check valve means connected to the main lines, the reverse-motion check valve means being brought temporarily to an open position under a restricting action of a damping small bore immediately after halt of the actuator to cause hydraulic fluid of high pressure to flow out of the main line on the fluid return side, thereby preventing a reverse motion of the inertial body, wherein regulating means is provided for selectively limiting outflow of the hydraulic fluid from the main line on the fluid return side through the reverse-motion check valve means, when the directional control valve is returned to a neutral position to halt the actuator.

With the invention constructed as described above, when the directional control valve is returned to the neutral position to halt the actuator, the reverse-motion check valve means essentially functions so that the hydraulic fluid of the high pressure flows out of the main line on the return side, but when the civil-engineering and construction machine is arranged on a slope to conduct operation in the low-temperature environment, the aforesaid regulating means functions so that outflow of the hydraulic fluid from the main line on the return side through the reverse-motion check valve means is selectively restricted. Thus, it is ensured that the actuator can be halted without being accompanied with abnormal operation.

BEST MODE FOR CARRYING OUT THE INVENTION

Embodiments of a hydraulic drive system for a civil-engineering and construction machine, according to the invention, will be described below with reference to the drawings.

FIRST EMBODIMENT

A first embodiment of the invention will first be described with reference to FIGS. 1~4.

Figure 1:
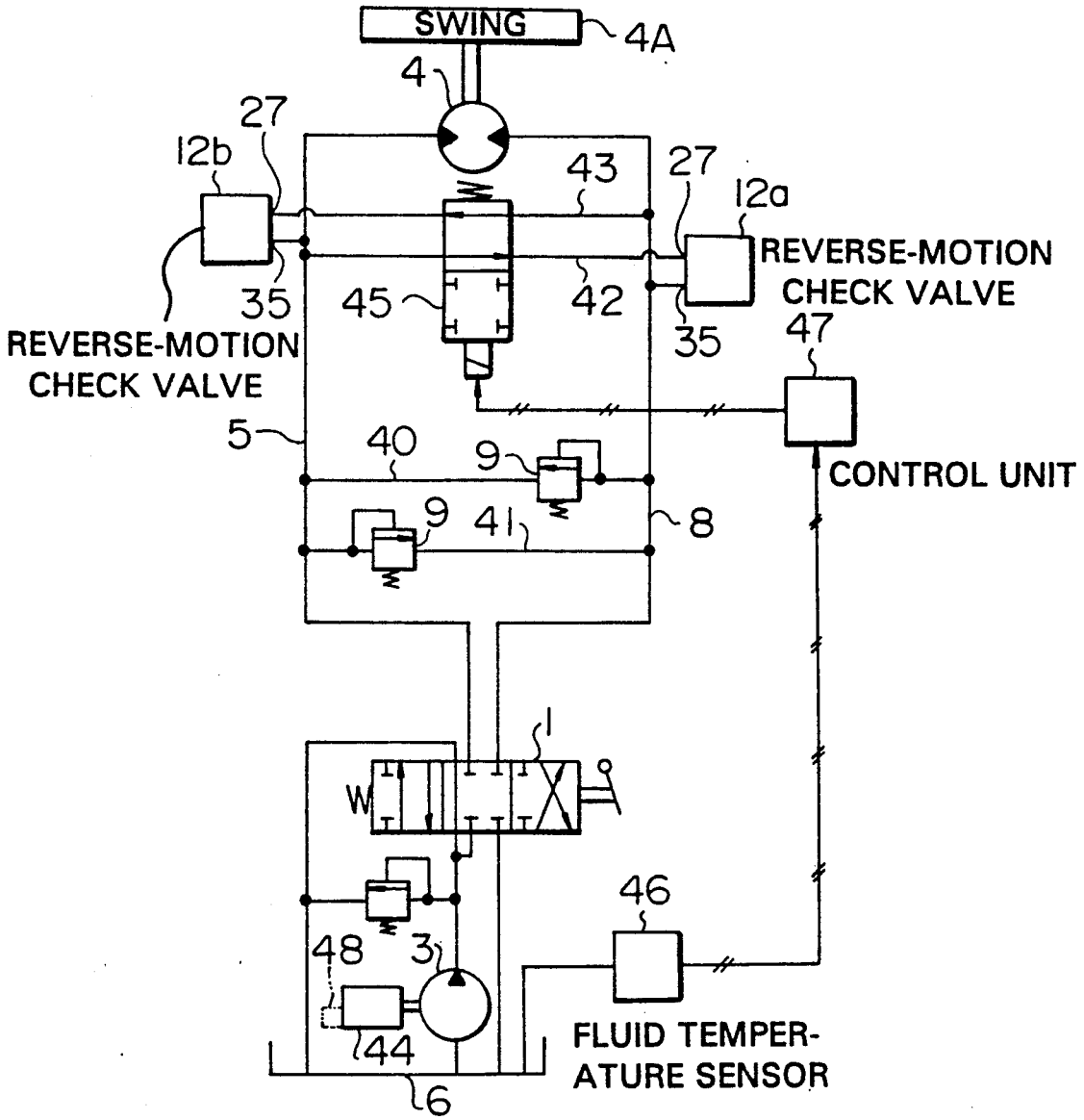
FIG. 1 is a schematic view of a hydraulic drive system for a civil-engineering and construction machine, according to an embodiment of the invention.

In FIG. 1, a hydraulic drive system according to the embodiment is installed on a hydraulic excavator, and comprises a prime mover 44, a hydraulic pump 3 forming a hydraulic-fluid source driven by the prime mover 44, a hydraulic motor 4 which is an actuator for driving a swing 4A that is an inertial body, a directional control valve 1 for controlling flow of hydraulic fluid supplied from the hydraulic pump 3 to the hydraulic motor 4, a pair of main lines 5 and 8 through which the directional control valve 1 is connected to the hydraulic motor 4, the main lines 5 and 8 functioning selectively as a fluid supply line and a fluid return line by switching of the directional control valve 1, a pair of relief valves 9 and 9 provided respectively in lines 40 and 41 through which the main lines 5 and 8 are connected to each other, a tank 6, a reverse-motion check valve **12*a* having a secondary port 35 communicating with the main line 8 and a primary port 27 communicating with a connecting line 42 connected to the main line 5, for preventing a reverse motion of the swing 4A at stop or halt operation thereof, and a reverse-motion check valve 12*b* having a secondary port 35 communicating with the main line 5 and a primary port 27 communicating with a connecting line 43 connected to the main line 8**.

The directional control valve 1 is a valve of closed-center type in which the hydraulic fluid is prevented from being returned to the tank 6 from the main lines 5 and 8 at a neutral position. In the embodiment, the directional control valve 1 and the pair of relief valves 9 and 9 cooperate with each other to form brake means for the hydraulic motor 4.

Each of the reverse-motion check valves **12*a* and 12*b* has a construction disclosed in JP, A, 57-25570. That is, in FIG. 2, a valve body 14 mounted to a case 13 is provided with a pair of bores 17 and 18 divided by an intermediate partition wall 16 through which a through bore 15 is formed. A spring 19 and a poppet 20 are successively fitted in the bore 17, and the spring 19 is set to a predetermined pressure by a plug 21. A movable seat 22 is inserted into the through bore 15 and the bore 18. The movable seat 22 is abutted against the poppet 20 by a spring 23 interposed between the movable seat 22 and the case 13. A volume chamber 24 is defined between the movable seat 22 and the valve body 14 at the intermediate partition wall 16. The volume chamber 24 communicates with the primary port 27 through a damping small bore 25 and a passage 26. Further, the poppet 20 defines a cylinder section 28 on the side of the plug 21, which is larger in diameter than the through bore 15. A piston 29 is fitted in the cylinder section 28. The cylinder section 28 communicates with the primary port 27 through a poppet axial bore 30 and a seat axial bore 31. A thrust force overcoming the movable seat 22 is produced on the poppet 20 by the hydraulic pressure at the primary port 27. A spring chamber 32 at the bore 17 is connected to the secondary port 35 through a through bore 33 and an annular groove 34. The secondary port 35 is connected to the main line 5 or 8. The primary port 27 is connected to the main line 8 or 5**.

In addition to the above-described arrangement, the first embodiment comprises valve means, for example, a solenoid selector valve 45 for opening and closing the aforesaid connecting lines 42 and 43, a fluid temperature sensor 46 for detecting a temperature of the hydraulic fluid flowing through the circuit, and a control unit 47 for outputting a drive signal for driving the solenoid selector valve 45 in accordance with a signal outputted from the fluid temperature sensor 46. The control unit 47 has, for example, an input section, an output section, a memory section and a computation section for conducting logical judgment. Beforehand stored in the memory section is, as a set temperature, a relatively low fluid temperature equivalent to a fluid temperature which is considered to cause scamper of the hydraulic motor 4, that is, abnormal operation thereof to occur if the reverse-motion check valves 12*a* and 12*b* operate upon halt of the swing 4A when the hydraulic excavator is arranged on a slope. Moreover, incorporated in the computation section is command means for judging whether or not a signal value outputted from the fluid temperature sensor 46 is lower than the aforementioned set temperature. When it is judged that the signal value is lower than the set temperature, the command means commands such that the aforesaid solenoid selector valve 45 is switched to the cutoff position.

In the first embodiment, the solenoid selector valve 45, the fluid temperature sensor 46 and the control device 47 cooperate with each other to form regulating means for selectively limiting outflow of the hydraulic fluid from the main line 5 or 8 on the fluid return side through the reverse-motion check valves 12*a* and 12*b* when the directional control valve 1 is returned to the neutral position to halt the hydraulic motor 4.

The reverse motion accompanied with halt operation of the inertial body will next be described.

Figure 3:
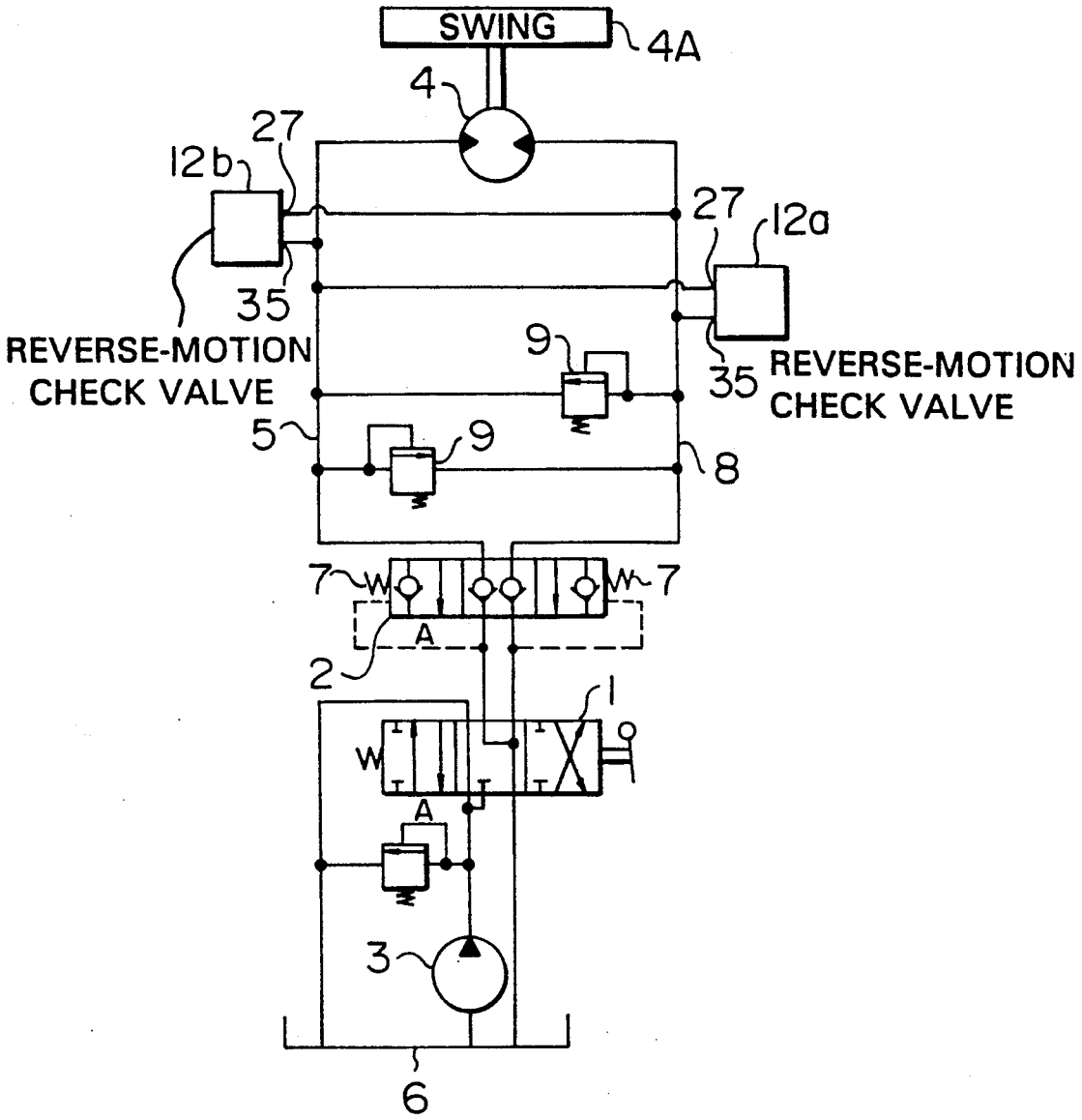
FIG. 3 PRIOR ART
FIG. 3 is a schematic view of a conventional hydraulic drive system provided with a pair of reverse-motion check valves.

FIG. 3 shows a conventional hydraulic drive system for a civil-engineering and construction machine, which comprises a pair of reverse-motion check valves, as disclosed in JP, A, 57-25570. In this hydraulic drive system, if a pair of reverse-motion check valves 12*a* and 12*b* illustrated in FIG. 3 are not provided, a reverse motion of the inertial body occurs as follows upon halt operation of a swing 4A that is an inertial body. In this connection, the conventional hydraulic drive system uses a directional control valve 1 of open center type, and comprises a counter balance valve 2 as brake means.

In FIG. 3, when the directional control valve 1 is switched, for example, to a position A, the counter balance valve 2 is switched to a position A by a hydraulic pressure from a hydraulic pump 3 which acts on the left-hand end of a spool. A hydraulic motor 4 is rotated by the hydraulic fluid introduced through a main line 5. Thus, the swing 4A that is the inertial body is swung in one direction. When the directional control valve 1 is returned to a neutral position in order to halt swinging, the pump 3 communicates with a tank 6, and the counter balance valve 2 is returned to a neutral position by forces of a pair of respective springs 7 and 7 at both ends because pressure chambers on both the ends communicate with the tank 6. On the other hand, the hydraulic motor 4 conducts a pumping action by an inertial force of the swing 4A. This returns the hydraulic fluid drawn from the tank through the main line 5 to the main line 8 cut off from communication with the tank. Thus, the pressure in the main line 8 rises abruptly. When a magnitude of the pressure exceeds a set pressure of a corresponding one of relief valves 9 and 9, the relief valve is moved to an open position. The hydraulic fluid is recirculated through a closed circuit connecting the relief valve 9 and the hydraulic motor 4 to each other, so that the hydraulic motor 4 is braked. Subsequently, the relief valve 9 is moved to its closed position, and the hydraulic motor 4 is halted while the main line 8 is maintained at high pressure. Accordingly, a differential pressure occurs between inlet and outlet ports of the hydraulic motor 4. By the differential pressure, the hydraulic motor 4 initiates to be rotated reversely so that the differential pressure across the hydraulic motor 4 is nullified. However, the hydraulic motor 4 continues to be further rotated in the same direction by the inertial force of the swing 4A. Thus, this time, the main line 5 is brought to a high pressure. A differential pressure occurs across the hydraulic motor 4 so that the latter again initiates to be rotated reversely. In this manner, if the reverse-motion check valves 12*a* and 12*b* are not provided, there occurs a reverse motion in which the swing 4A is moved angularly a plurality of times by the inertial force of the swing 4A in spite of the fact that halt of the swing 4A is intended.

The aforesaid description is directed to the case where the hydraulic motor 4 is braked by the operation of the counter balance valve 2. It will be understood, however, that in the present embodiment illustrated in FIG. 1, the hydraulic motor 4 may be braked similarly by return of the directional control valve 1 of closed center type to the neutral position, and a similar reverse motion occurs.

Figure 2:
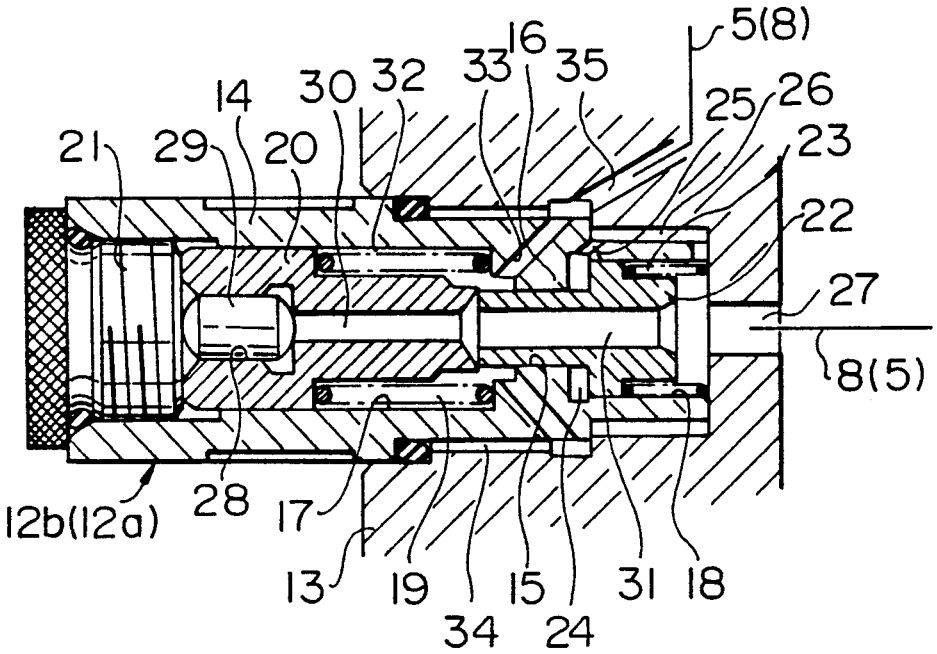
FIG. 2 is a cross-sectional view of one of a pair of reverse-motion check valves illustrated in FIG. 1.

The operation of the reverse-motion check valves 12*a* and 12*b* and problems of the conventional hydraulic drive system provided with the reverse-motion check valves will be described with reference to FIGS. 2 and 3.

The hydraulic drive system illustrated in FIG. 3 comprises the reverse-motion check valves 12*a* and 12*b* in order to prevent the above-described reverse motion. Under such a condition that the hydraulic-motor fluid is supplied through the main line 5 to drive the swing 4A in one direction as described above, the piston 29 of the reverse-motion check valve 12*a* connecting a primary port 27 to the main line 5 is abutted against the plug 21 because the high pressure in the main line 5 acts on the movable seat 22 and the poppet 20. The poppet 20 abuts against the movable seat 22 at an intermediate position which is determined by the thrust force on the piston 29 and by the thrust force on the movable seat 22 opposed to the thrust force on the piston 29 and the springs 19 and 23. On the other hand, the poppet 20 of the reverse-motion check valve **12*b* connecting a primary port 27 to the main line 8 is located at the end of the left stroke and abuts against the movable seat 22 because the high pressure in the main line 5 acts on the spring chamber 32 through the secondary port 35**.

When the directional control valve 1 is switched to the neutral position from the above-described position to halt the swing 4A as described above, the pressure in the main line 8 rises abruptly. When the abruptly increasing pressure exceeds the set pressure of the relief valve 9, the relief valve is moved to its open position. The hydraulic fluid is recirculated through the closed circuit communicating the relief valve 9 and the hydraulic motor 4 to each other. Thus, a brake force is applied to the hydraulic motor 4. During braking of the hydraulic motor 4, the poppet 20 of the reverse-motion check valve **12*a* connecting the primary port 27 to the main line 5 is located at the end of the left stroke and abuts against the movable seat 22 because the pressure in the main line 8 brought to the high pressure acts on the spring chamber 32 through a secondary port 35. However, the poppet 20 of the reverse-motion check valve 12*b* connecting the primary port 27 to the main line 8 is displaced to the right while abutting against the movable seat 22, in opposition to the springs 19 and 23 and the thrust force of the movable seat 22, because the hydraulic pressure in the main line 8 brought to the high pressure acts on the poppet 20 and the movable seat 22**.

As the brake action approaches an end, the relief valve 9 is brought in due course to its closed position. Subsequently, as the hydraulic motor 4 is halted, the pressure in the main line 8 is reduced before and after the halt at the speed higher than a given pressure-drop speed owing to leak from the hydraulic motor 4 and the counter balance valve 2, an opening characteristic of the relief valve 9 and the like. Accordingly, the poppet 20 of the reverse-motion check valve **12*b* is moved together with the movable seat 22 to the left under the forces of the respective springs 19 and 23. At this time, since the hydraulic fluid returned from the volume chamber 24 is restricted by the damping small bore 25, movement of the movable seat 22 is retarded more than the poppet 20 by the damping action of the small bore 25. That is, the reverse-motion check valve 12*b* is brought to an open position. Thus, the main line 8 and the main line 5 communicate with each other, and the high pressure in the main line 8 escapes to the main line 5. At a point of time the movable seat 22 abuts against the poppet 20, energy required for reverse rotation of the swing 4A disappears so that a reverse motion of the swing 4A does not occur. In this connection, in the case where the main line 5 is brought to a high pressure at halt operation of the swing 4A, the reverse-motion check valve 12*a* is brought to an open position similarly to the above so that the main line 5 and the main line 8 communicate with each other. Thus, the reverse motion of the swing 4A** does not occur.

By the way, in the prior art, as described above, the hydraulic fluid is returned from the volume chamber 24 through the damping small bore 25 at halt of the swing 4A, in order to prevent the reverse motion of the swing 4A that is the inertial body. However, there occurs a problem in a low-temperature environment and in the case where the hydraulic excavator is arranged on a slope. That is, since the viscosity of the hydraulic fluid increases when the hydraulic fluid is low in temperature, the return speed of the movable seat 22 is retarded so that the communication between the lines 8 and 5 continues too long. Accordingly, in the case where any one of the main lines 8 and 5 is brought to a high pressure accompanied with the halt operation of the swing 4A, the reverse-motion check valve **12*b* or the reverse-motion check valve 12*a* continues the opening relatively long as described above. Accordingly, the hydraulic fluid in the main line 8 or the main line 5 flows into the main line on the opposite side, so that the swing motor is abnormally rotated in opposition to intention. After all, there occurs such a situation that the swing 4A** is rotated transiently. Such transient rotation results in a reduction of working efficiency and, in addition thereto, there occurs such problems that operability is reduced, and the like.

According to the embodiment, in the hydraulic drive system provided with the reverse-motion check valves, the above-discussed problems are solved as follows.

Figure 4:
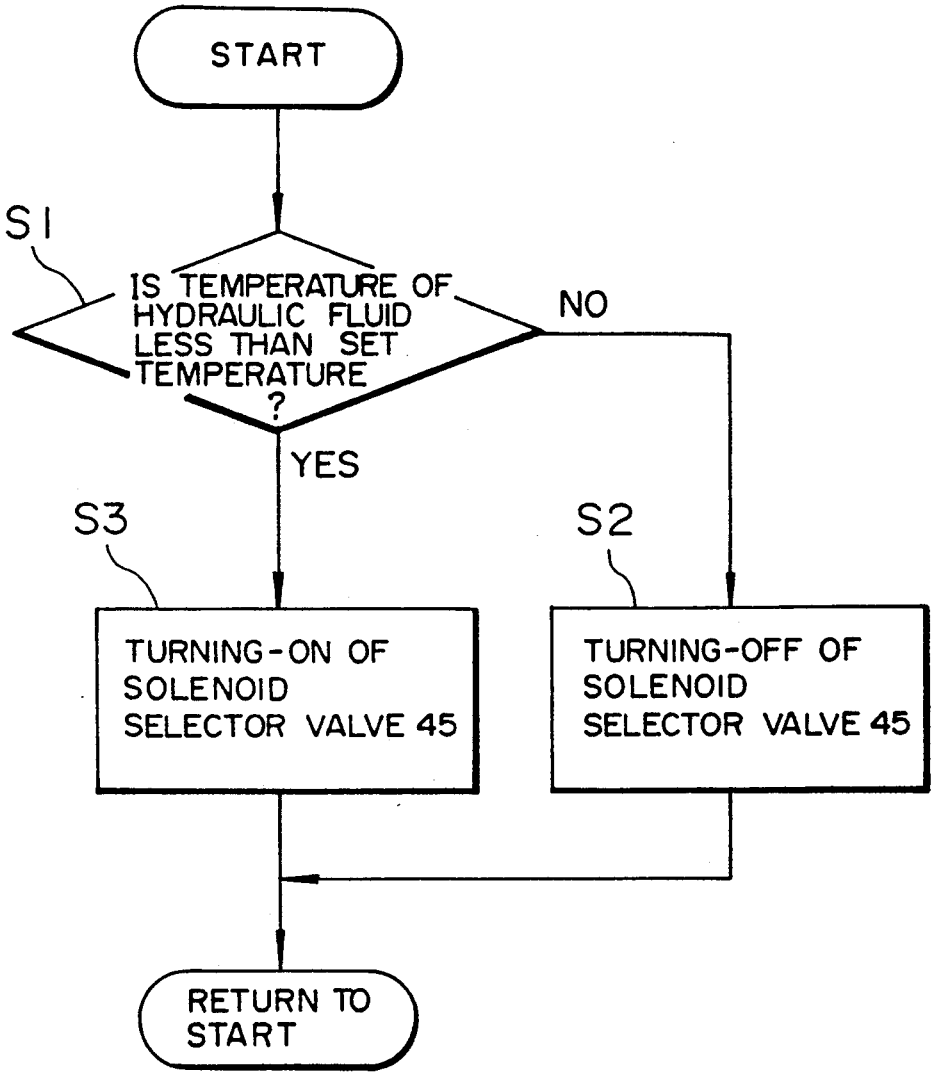
FIG. 4 is a flow chart showing the processing executed by a control unit illustrated in FIG. 1.

In the embodiment, when the hydraulic excavator is arranged on a slope, processing illustrated in FIG. 4 is conducted by the control unit 47 in accordance with the signal outputted from the fluid temperature sensor 46. That is, as indicated by a step S1 in FIG. 4, set temperature beforehand stored in the memory section is read out by the computation section. The computation section judges whether or not the signal value outputted from the fluid temperature sensor 46, that is, the fluid temperature is equal to or less than the set temperature. If the judgment is not satisfied, this indicates that the hydraulic fluid is relatively high in temperature such that environmental temperature is, for example, the normal or ordinary temperature, or the like. A program proceeds to a step S2 where a drive signal for turning off the solenoid selector valve 45, that is, for bringing the solenoid selector valve 45 to the communicating position as illustrated in FIG. 1 is outputted from the output section. Thus, the solenoid selector valve 45 is maintained in the condition illustrated in FIG. 1. Under the condition, however, when the directional control valve 1 is switched to the neutral position from the left- or right-hand position and the swing 4A is shifted from the swinging movement to the halt movement, the reverse-motion check valve **12*a* or the reverse-motion check valve 12*b* functions in the manner described previously at halt of the swing 4A so that the hydraulic fluid on the high-pressure side in the main line 5 or the main line 8, which is introduced through the connecting line 42 or the connecting line 43, flows into the main line 8 or the main line 5 on the other side. Thus, the differential pressure across the hydraulic motor 4 is nullified so that the swinging motion of the swing 4A is prevented. In this case, since the fluid temperature is relatively high, the viscosity of the hydraulic fluid is low so that the hydraulic fluid flows through the aforementioned damping small bore 25 illustrated in FIG. 2, of the reverse-motion check valves 12*a* and 12*b*, for a relatively short period of time. The return movement of the movable seat 22 is relatively fast, and time brought to the open position is relatively short. Thus, there occurs no scamper of the hydraulic motor 4**, that is, no abnormal operation thereof.

Further, when the judgment at the step S1 in FIG. 4 is satisfied, this indicates that the environmental temperature is considerably low as compared with the normal temperature such as operation in a cold district and the like. The program proceeds to a step S3 where a signal for turning on the solenoid selector valve 45 illustrated in FIG. 1, that is, for bringing the solenoid selector valve 45 to a lower position in FIG. 1 is outputted from the output section. Thus, the connecting lines 42 and 43 are brought to their respective cutoff conditions so that the functions of the respective reverse-motion check valves 12*a* and 12*b* are halted. Under the condition, when the swing 4A is shifted from the swing movement to the halt movement, no hydraulic fluid flows through the connecting line 42 or the connecting line 43 at halt of the swing 4A. It is ensured that the hydraulic motor 4 is prevented from being scampered away though there is a fear that a slight reverse motion occurs.

In this manner, in the first embodiment, when the hydraulic excavator is arranged on a slope and when the environmental temperature is low and the temperature of the hydraulic fluid is lower than the set temperature, the abnormal operation of the hydraulic motor 4 can be prevented from occurring at halt from swinging. Accordingly, reduction of the working efficiency due to the abnormal operation of the hydraulic motor 4 can be prevented from occurring and, in addition thereto, superior safety can be ensured and the operability can be improved.

In the above-described first embodiment, the fluid temperature sensor 46 is provided. In place of the fluid temperature sensor 46, however, the arrangement may be as follows. That is, as illustrated by the two-dot-and-dash line in FIG. 1, a water temperature sensor 48 is provided for detecting temperature of water in the prime mover, which changes temperature correspondingly to the temperature of the hydraulic fluid. Stored beforehand in the memory section of the control unit 47 is, as a set temperature, a temperature of water in the prime mover corresponding to relatively low temperature of the hydraulic fluid which is equivalent to the temperature of the hydraulic fluid considered to cause the abnormal operation of the hydraulic motor 4 to occur if the reverse-motion check valves 12*a* and 12*b* operate at halt of the swing 4A, when the hydraulic excavator is arranged on a slope. Incorporated in the computation section is means for judging whether or not a signal value outputted from the water temperature sensor 48 is lower than the aforesaid set temperature. If the judgment indicates that the signal value is lower than the set temperature, the means commands so as to turn off the solenoid selector valve 45. That is, nullifying means that is regulating means may be formed by the solenoid selector valve 45, the water temperature sensor 48 and the control unit 47.

The above-described arrangement can produce advantages substantially similar to those of the aforesaid first embodiment, though the water temperature in the prime mover is detected in substitution for the temperature of the hydraulic fluid.

SECOND EMBODIMENT

A second embodiment of the invention will be described with reference to FIGS. 5 and 6.

Figure 5:
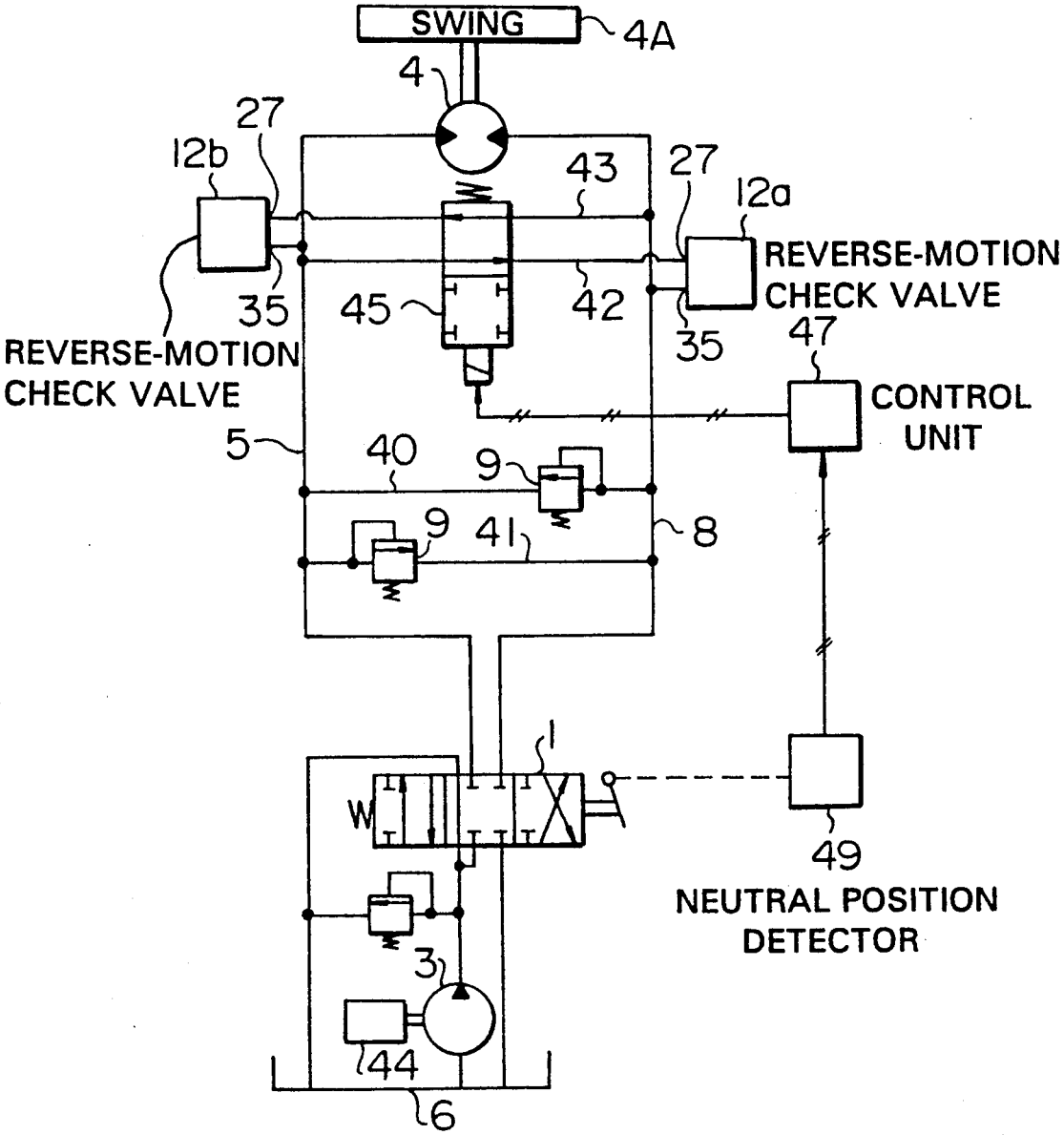
FIG. 5 is a schematic view of a hydraulic drive system for a civil-engineering and construction machine, according to a second embodiment of the invention.

As shown in FIG. 5, in the second embodiment, an operation detector 49 is provided for detecting whether or not the directional control valve 1 is returned to the neutral position. Stored beforehand in the memory section of the control unit 47 is, as a set time, a time required for the reverse-motion check valves 12*a* and 12*b* to operate to restrain the reverse motion when the directional control valve 1 is returned to the neutral position to halt the swing 4A when, for example, the environmental temperature is the normal temperature and the hydraulic excavator is arranged on a slope, that is, a time assumed to be required from return of the directional control valve 1 to the neutral position to the above-described halt of the swing 4A at the normal temperature. Furthermore, incorporated in the computation section is such means that computes a period from a point of time a neutral detecting signal outputted from the operation detector 49 is inputted to obtain the lapse time, judges whether or not the lapse time exceeds the aforementioned set time, and issues a command to turn off the solenoid selector valve 45 when it is judged that the lapse time exceeds the set time. Otherwise, the arrangement is equivalent to that of the first embodiment illustrated in FIG. 1.

In the second embodiment, the solenoid selector valve 45, the operation detector 49 and the control device 47 cooperate with each other to form regulating means for selectively limiting outflow of the hydraulic fluid from the main line 5 or 8 on the fluid return side through the reverse-motion check valves 12*a* and 12*b* when the directional control valve 1 is returned to the neutral position to halt the hydraulic motor 4.

Figure 6:
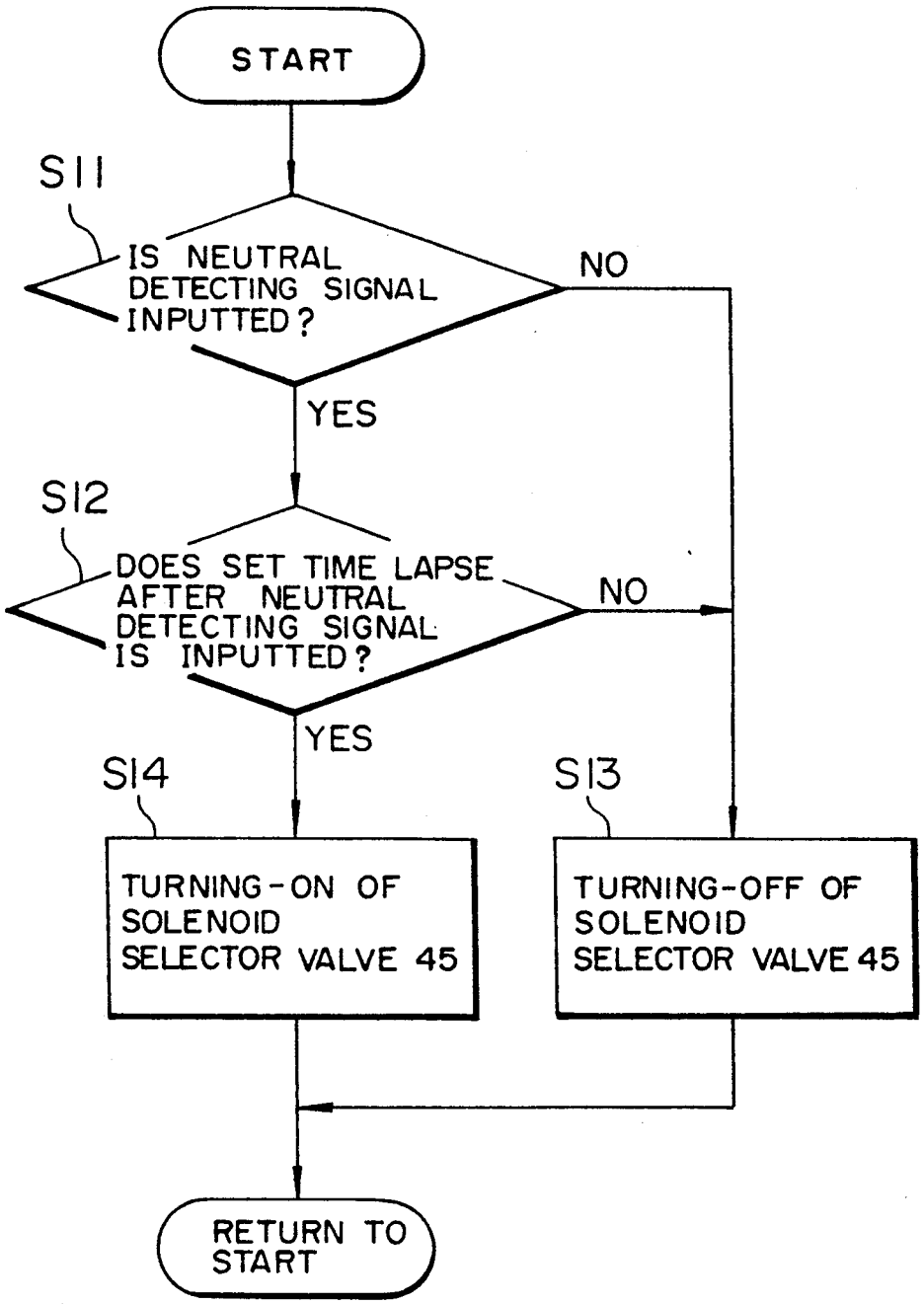
FIG. 6 is a flow chart showing the processing executed by a control unit illustrated in FIG. 5.

In the second embodiment constructed as described above, when the hydraulic excavator is arranged on a slope and when the directional control valve 1 is returned to the neutral position to halt swinging, the return movement of the directional control valve 1 to the neutral position is detected by the operation detector 49, and processing illustrated in FIG. 6 is conducted by the control unit 47 in accordance with a neutral detecting signal detected by the operation detector 49. That is, as shown in a step S11 in FIG. 6, the computation section of the control unit 47 first judges whether or not the neutral detecting signal is inputted. If it is now assumed that the neutral detecting signal is inputted, the aforesaid judgment is satisfied, and the program proceeds to a step S12. At the step S12, set time stored beforehand in the memory section is read out by the computation section. On the other hand, computation is conducted by the computation section to obtain lapse time from a point of time the aforementioned neutral detecting signal is inputted, and it is judge whether or not the lapse time exceeds the above-described set time. If this judgment is not satisfied, this indicates such a condition that it is assumed that halt of the swing 4A from swinging thereof has not reached completion. The program proceeds to a step S13. In the step S13, the output section outputs a drive signal for turning off the solenoid selector valve 45, that is, for bringing the solenoid selector valve 45 to the communicating position illustrated in FIG. 5. Thus, the solenoid selector valve 45 is maintained in the position illustrated in FIG. 5, so that the reverse-motion check valve 12*a* or the reverse-motion check valve 12*b* functions to allow the hydraulic fluid in one of the main line 5 and the main line 8 on the high-pressure side introduced through the connecting line 42 or the connecting line 43 to flow into the other of the main line 8 and the main line 5. Thus, the differential pressure across the hydraulic motor 4 is nullified, and the swing 4A is brought to such a condition that the reverse motion of the swing 4A does not occur.

In this case, since the reverse-motion check valves 12a and 12b are maintained at their respective open positions even in the case where the temperature of the hydraulic fluid is low and the viscosity thereof is high, the hydraulic fluid flows through the connecting lines 42 and 43.

If the judgment in the step S11 in FIG. 6 is not satisfied, it is meant that the directional control valve 1 shown in FIG. 5 is switched to the left- and right-hand positions to conduct swinging movement. In this case, it is not required to cut off the connecting lines 42 and 43. Accordingly, the program proceeds to the step S13 where the solenoid selector valve 45 is turned off to take the communicating position illustrated in FIG. 5.

Further, in the case where the judgment in the step S12 is satisfied and the lapse the determined from the time the directional control valve 1 is returned to the neutral position exceeds the set time, the program proceeds to a step S14. In the step S14, the output section outputs a signal to turn on the solenoid selector valve 45 illustrated in FIG. 5, that is, bring it to the lower position shown in FIG. 5. Thus, the connecting lines 42 and 43 are cut off so that the function of each of the reverse-motion check valves 12a and 12b halts. Accordingly, as this condition nears, there is no flow of the hydraulic fluid through the connecting lines 42 and 43. Even in a low-temperature environment in which the temperature of the hydraulic fluid decreases, it is ensured that scamper of the hydraulic motor 4, that is, abnormal operation thereof is prevented from occurring. Thus, there are produced advantages similar to those of the aforesaid first embodiment.

THIRD EMBODIMENT

A third embodiment of the invention will be described with reference to FIGS. 7 and 8.

Figure 7:
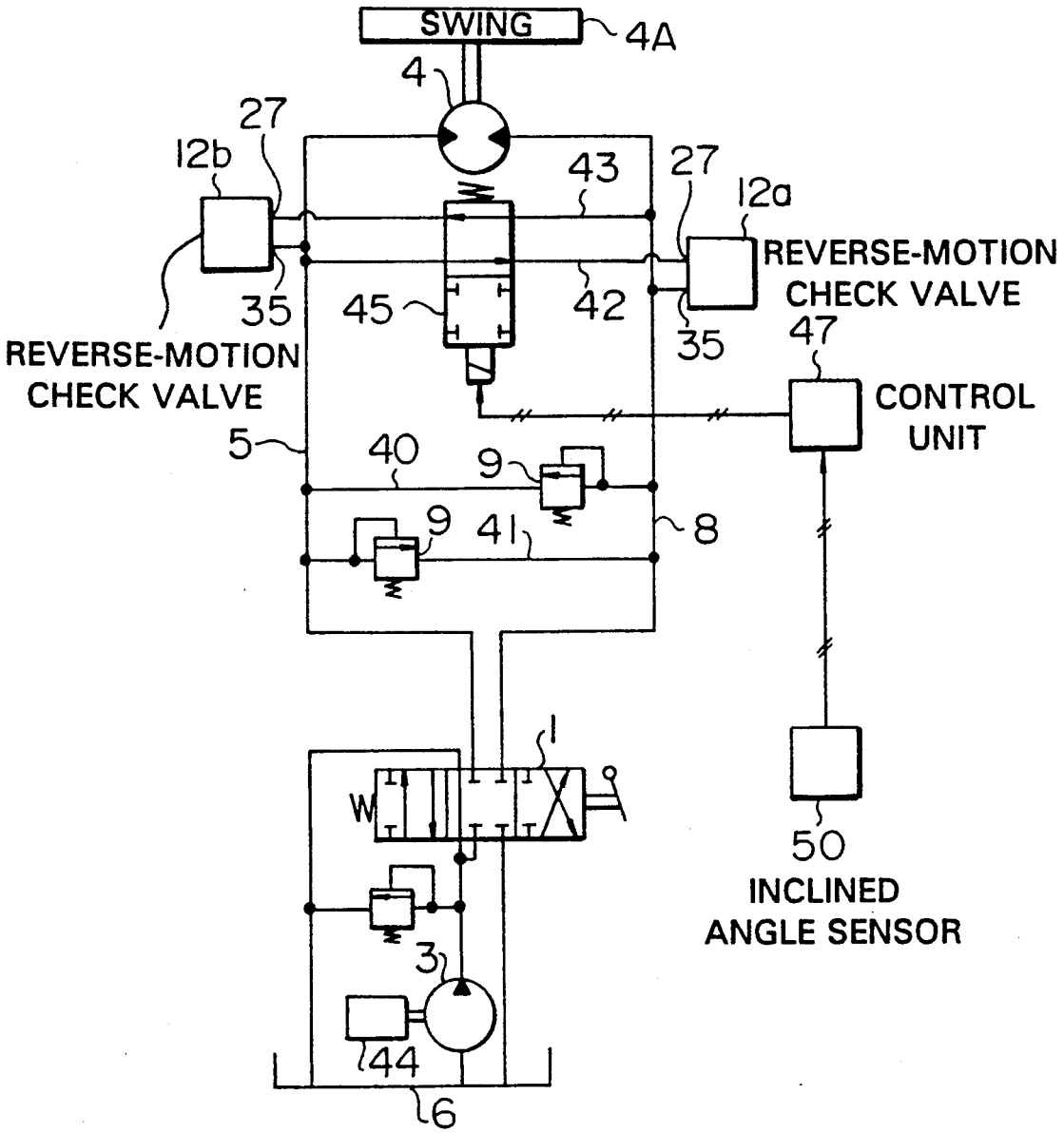
FIG. 7 is a schematic view of a hydraulic drive system for a civil-engineering and construction machine, according to a third embodiment of the invention.
Figure 8:
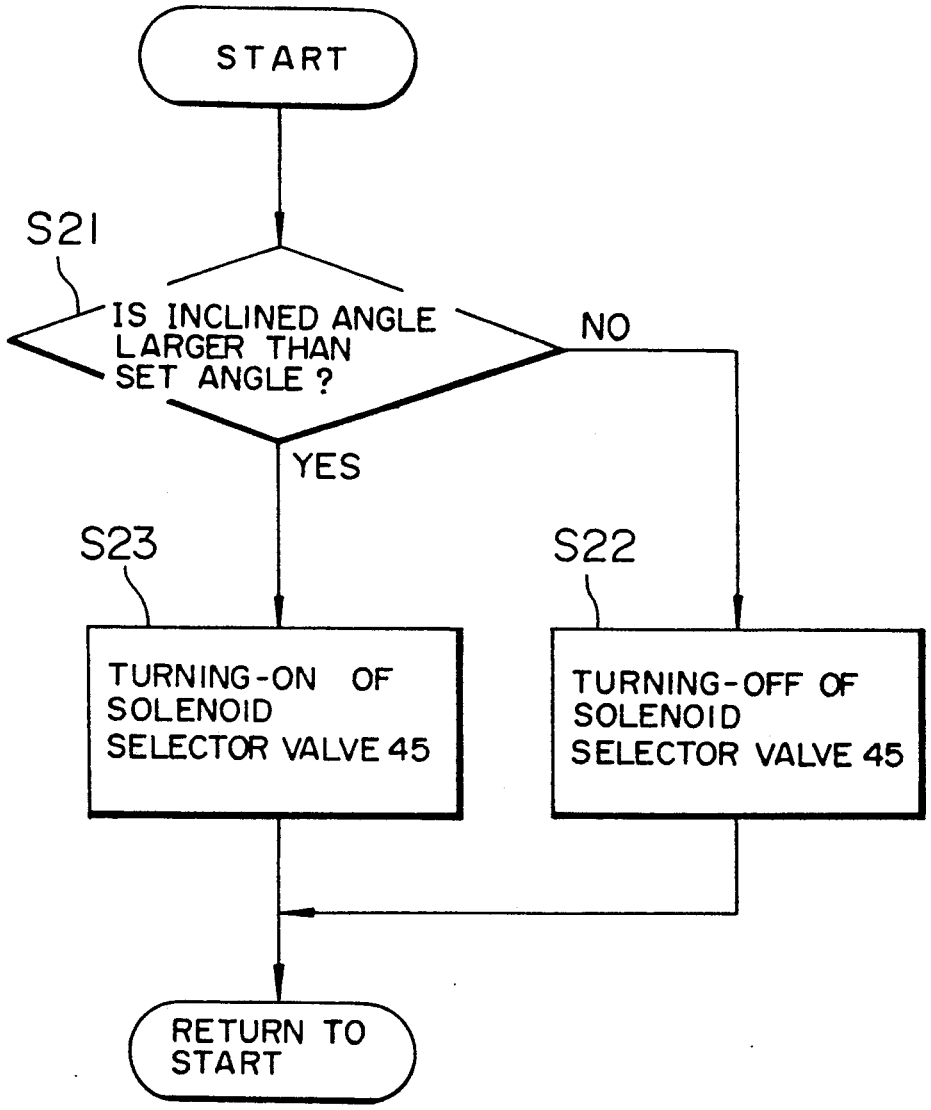
FIG. 8 is a flow chart showing the processing executed by a control unit illustrated in FIG. 7.

As shown in FIG. 7, the third embodiment comprises an inclined-angle sensor 50. The inclined-angle sensor 50 is connected to the control unit 47 and is mounted on a body of the hydraulic excavator, for example, for detecting an inclined angle of the hydraulic excavator. Stored beforehand in the memory section of the control unit 47 is, as a set angle, an inclined angle corresponding to a slope in which, when the hydraulic excavator is arranged, the hydraulic excavator is brought to such an inclined condition that abnormal operation of the hydraulic motor 4 occurs in the case where the hydraulic fluid is low in temperature. Furthermore, incorporated in the computation section is means for judging whether or not a value outputted from the inclined-angle sensor 50 is larger than the aforesaid set inclined angle, and issues a command to turn off the solenoid selector valve 45 when the value outputted from the inclined-angle sensor 50 is larger than the set inclined angle. Other arrangement is equivalent to that of the aforementioned first embodiment, for example.

In the third embodiment, the solenoid selector valve 45, the inclined-angle sensor 50 and the control unit 47 cooperate with each other to form regulating means for selectively limiting outflow of the hydraulic fluid from the main line 5 or 8 on the fluid return side through the reverse-motion check valves 12a and 12b when the directional control valve 1 is returned to the neutral position to halt the hydraulic motor 4.

In the third embodiment constructed as described above, processing illustrated in FIG. 8 is conducted by the control unit 47 in accordance with a signal outputted from the inclined-angle sensor 50 under such a condition, for example, that the hydraulic excavator is arranged on a slope. That is, as indicated by a step S21 in FIG. 8, the set angle stored beforehand in the memory section is read out by the computation section. It is judged in the computation section whether or not a signal value, that is, an inclined angle outputted from the inclined-angle sensor 50 is equal to or larger the set angle. If the judgement is not satisfied, this indicates the case where the angle of the slope is relatively small. The program proceeds to a step S22 where the output section outputs a drive signal for turning off the solenoid selector valve 45, that is, for bringing the solenoid selector valve 45 to the communicating position illustrated in FIG. 7. Thus, similarly to the case of the step S2 shown in FIG. 4, the differential pressure across the hydraulic motor 4 is nullified so that reverse motion of the swing 4A is prevented from occurring when the swing 4A is shifted from swinging movement to halt movement.

Moreover, if the judgement in the step S21 is satisfied, this indicates the case where the angle of the slope is relatively large. The program proceeds to a step S23 where the output section outputs a signal for turning on the solenoid selector valve 45 illustrated in FIG. 7, that is, for switching the solenoid selector valve 45 to the lower position in FIG. 7. Thus, the connecting lines 42 and 43 are cut off to halt function of each of the reverse-motion check valves 12a and 12b. Accordingly, even in the case where the environmental temperature is low and the temperature of the hydraulic fluid is accordingly low so that scamper of the hydraulic motor 4 may occur, there occurs no such scamper, that is, no abnormal operation. Similarly to the first and second embodiments, working efficiency can be prevented from being reduced and, in addition thereto, safety of the working can be ensured and operability can be improved.

FOURTH EMBODIMENT

Figure 9:
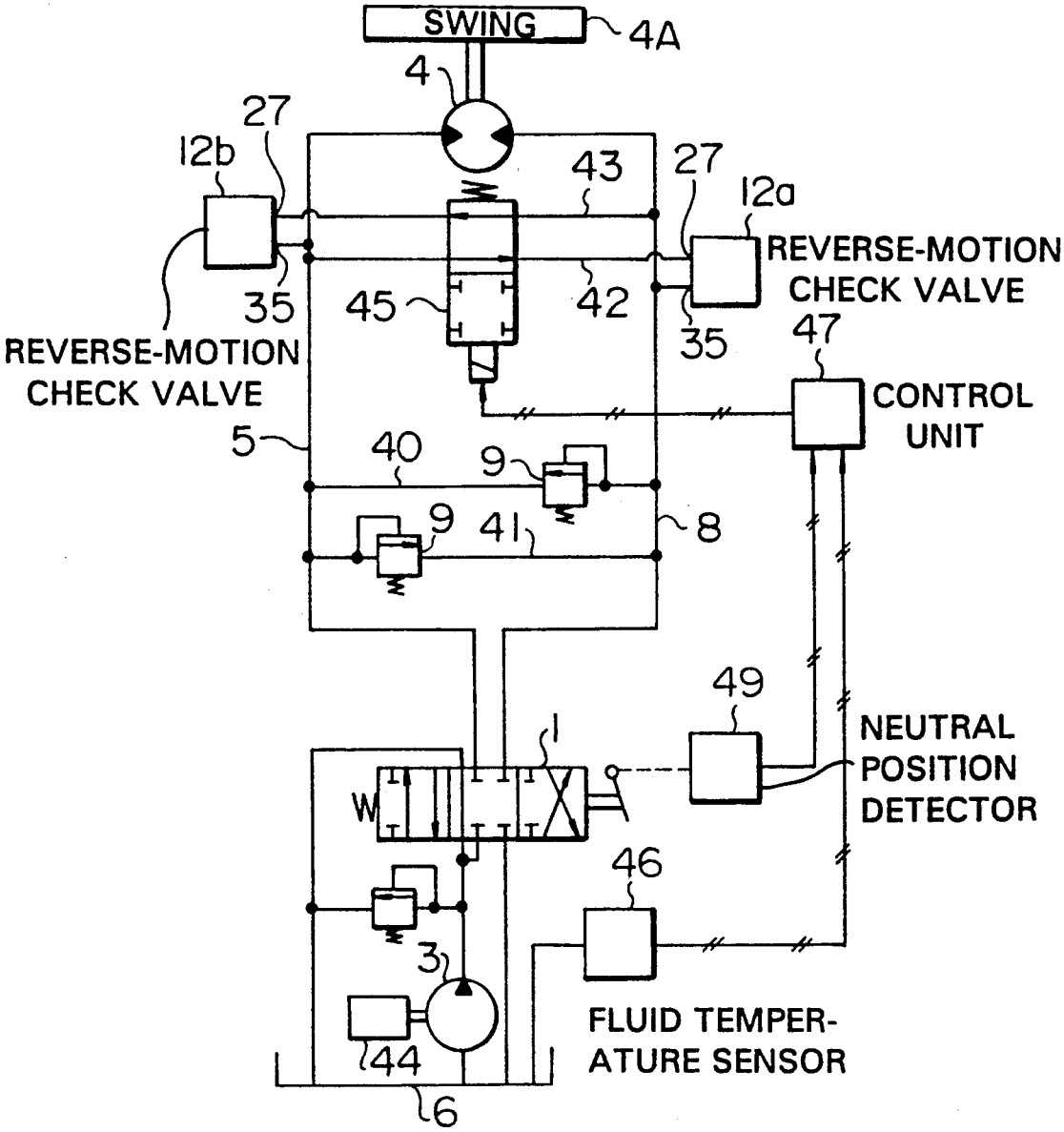
FIG. 9 is a schematic view of a hydraulic drive system for a civil-engineering and construction machine, according to a fourth embodiment of the invention.

A fourth embodiment of the invention will be described with reference to FIGS. 9 and 10.

In the fourth embodiment, regulating means for selectively limiting outflow of the hydraulic fluid from the main line 5 or 8 on the fluid return side through the reverse-motion check valves 12a and 12b when the directional control valve 1 is returned to the neutral position to halt the hydraulic motor 4 comprises a solenoid selector valve 45, an operation detector 49 for detecting whether or not the directional control valve 1 is returned to the neutral position, a fluid temperature sensor 46 for detecting temperature of the hydraulic fluid flowing through the circuit, and a control unit 47.

Figure 10:
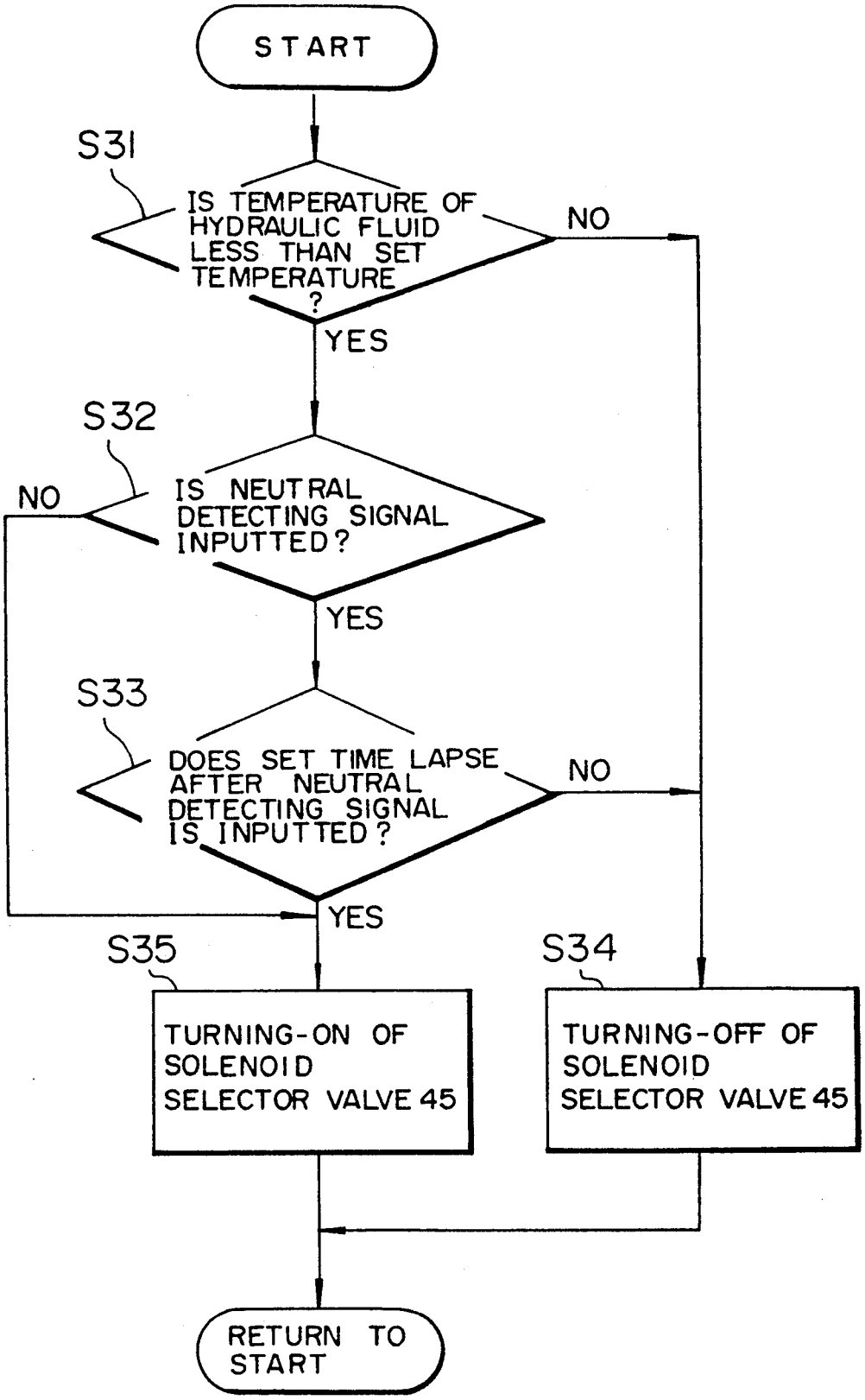
FIG. 10 is a flow chart showing the processing executed by a control unit illustrated in FIG. 9.

In the fourth embodiment, as indicated by steps S31, S32 and S35 in FIG. 10, the control unit 47 outputs a drive signal for turning on the solenoid selector valve 45 basically when the signal value outputted from the fluid temperature sensor 46 is lower than a set temperature. In the case where the temperature of the hydraulic fluid is low, when the directional control valve 1 is returned to the neutral position from a condition under which the valve 1 is switched to the left- or right-hand position in FIG. 9 and swinging movement is conducted, and the operation detector 49 detects this operation so that a neutral detecting signal is inputted to the control unit 47, the program proceeds from a step S33 to a step S34 where the drive signal for turning off the solenoid selector valve 45 is once outputted from the control unit 47. Thus, the solenoid selector valve 45 is switched to the communicating position shown in FIG. 9 to communicate the main lines 5 and 8 with each other. The reverse-motion check valves 12*a* and 12*b* function to restrict the reverse motion of the hydraulic motor 4. Subsequently, when the lapse time from returning of the directional control valve 1 to the neutral position exceeds the set time, the program proceeds from the step S33 to the step S35 where a drive signal for turning on the solenoid selector valve 45 is outputted from the control unit 47. Thus, the function of each of the reverse-motion check valves 12*a* and 12*b* is nullified so that scamper of the hydraulic motor 4, that is, abnormal operation can be prevented from occurring.

When the temperature of the hydraulic fluid is higher than the set temperature, the program proceeds from the step S31 to the step S34 to output a drive signal to turn off the solenoid selector valve 45 from the control unit 47 irrespective of the fact that the neutral detecting signal is outputted. Thus, the solenoid selector valve 45 is maintained in the communicating position illustrated in FIG. 9, and the connecting lines 42 and 43 are opened so that the reverse-motion check valves 12*a* and 12*b* function to prevent the reverse motion of the swing 4A from occurring at halt from swinging. At this time, since the temperature of the hydraulic fluid is higher than the set temperature, the viscosity of the hydraulic fluid is low as described previously. Accordingly, no abnormal operation of the hydraulic motor 4 occurs.

Figure 11:
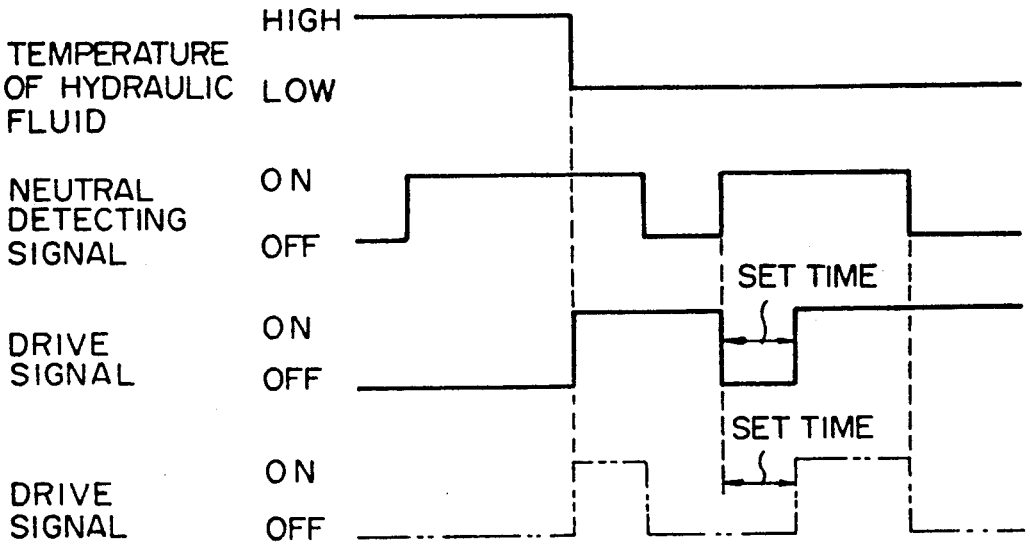
FIG. 11 is a view showing characteristics of the embodiment illustrated in FIG. 9.

The relationship between the temperature of the hydraulic fluid and the neutral detecting signal, and the drive signal in the above-described operation is shown in FIG. 11. That is, when the temperature of the hydraulic fluid is equal to or lower than the set temperature, the drive signal is basically brought to an ON condition, and only for a period of the set time immediately after the neutral detecting signal has been changed to an ON condition, the drive signal is brought to an OFF condition to allow the reverse-motion check valves 12*a* and 12*b* to communicate the pair of main lines 5 and 8 with each other.

In connection with the above, the above-described control is arranged such that the directional control valve 1 is returned to the neutral position (the neutral detecting signal being under the ON condition) from the left- or right-hand control position, that is, from the condition under which the swinging motion is conducted (the neutral detecting signal being under the OFF condition), and the drive signal is brought to the OFF condition for a period of the set time after the point of time the directional control valve is returned to the neutral position. However, a characteristic may be modified such that, as shown in FIG. 11 by a two-dot chain line, the drive signal is brought to the OFF condition from the point of time the directional control valve 1 is switched to the left- or right-hand position (the neutral detecting signal being under the OFF condition), and the drive signal is brought to the ON condition at the point of time the set time reaches after the directional control valve 1 is returned to the neutral position. In this case, the solenoid selector valve 45 is maintained in the communicating position illustrated in FIG. 9 even when the temperature of the hydraulic fluid is lower than the set temperature for a period of time during which the directional control valve 1 is switched to the left- or right-hand position, so that the connecting lines 42 and 43 are opened. During the time, however, the hydraulic motor 4 is brought to the drive condition to operate the hydraulic motor 4. Accordingly, the reverse-motion check valves 12*a* and 12*b* are brought to their respective closed positions and the main lines 5 and 8 are not connected to each other. Thus, no difficulty occurs in operation.

In the fourth embodiment constructed as described above, the solenoid selector valve 45 is turned on and off in accordance with both the signal from the fluid temperature sensor 46 and the signal from the operation detector 49, and even if the hydraulic excavator is arranged on a slope in a low-temperature environment, prevention of the reverse motion and the abnormal operation of the hydraulic motor 4 can be realized as described previously. Thus, there can be produced advantages similar to those of the first embodiment.

In the fourth embodiment, a water temperature sensor 48 for detecting temperature of water in the prime mover may be provided in substitution for the fluid temperature sensor 46 so that driving of the solenoid selector valve 45 is controlled in accordance with both the signal outputted from the water temperature sensor 48 and the signal outputted from the operation detector 49. This can produce advantages substantially similar to those of the fourth embodiment.

FIFTH EMBODIMENT

A fifth embodiment of the invention will be described with reference to FIGS. 12 and 13.

Figure 12:
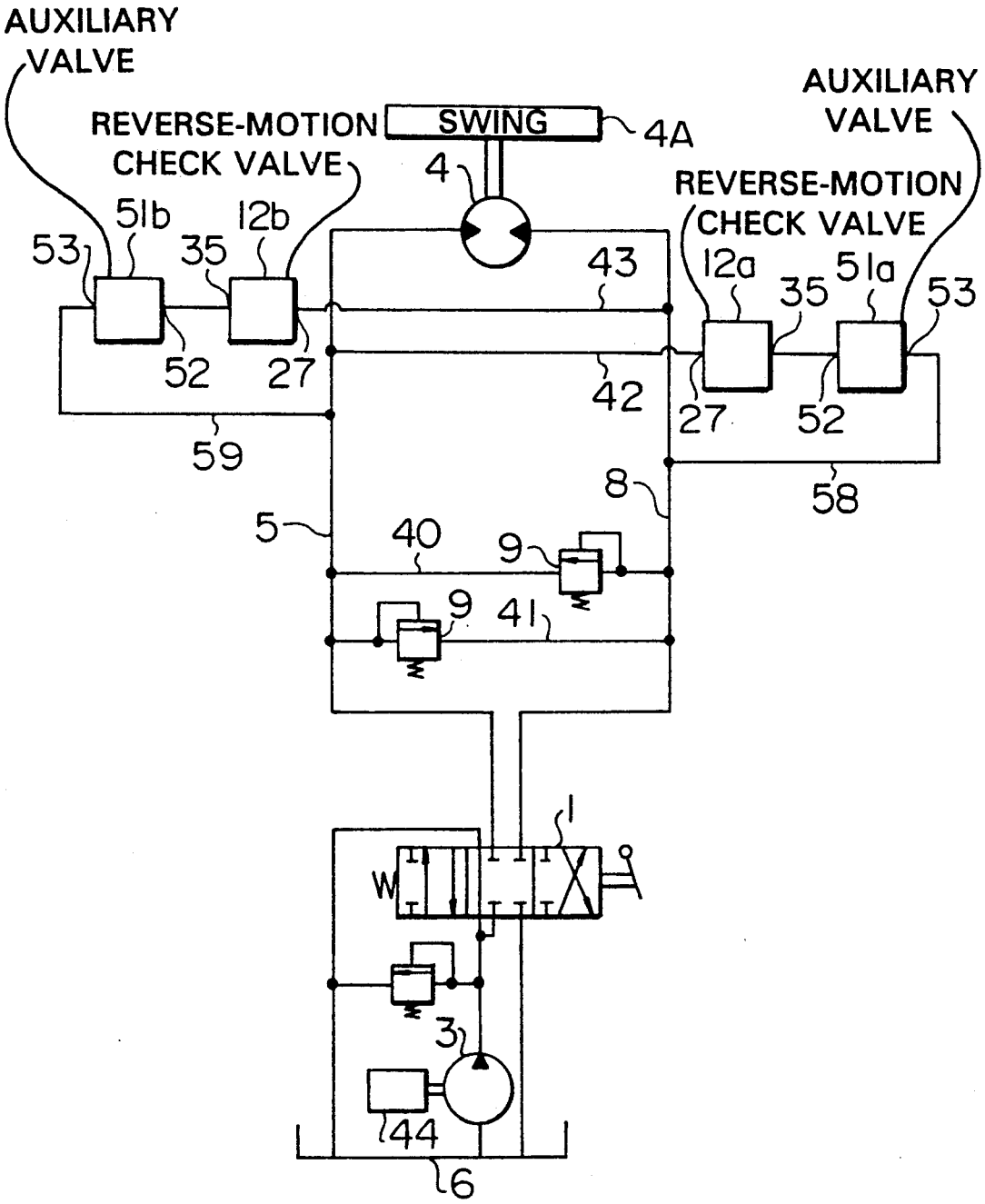
FIG. 12 is a schematic view of a hydraulic drive system for a civil-engineering and construction machine, according to a fifth embodiment of the invention.
Figure 13:
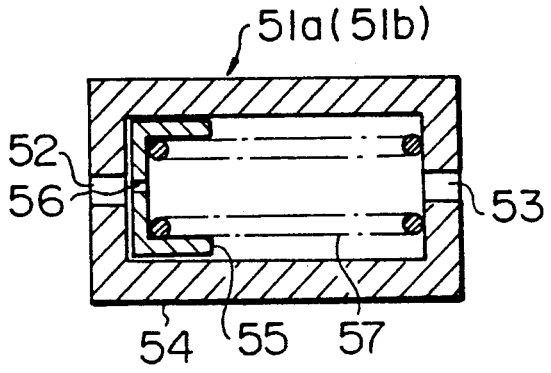
FIG. 13 is a cross-sectional view of one of a pair of auxiliary valves illustrated in FIG. 12.

The fifth embodiment illustrated in FIG. 12 comprises an auxiliary valve 51*a* arranged in a line 58 connecting the main line 8 and the reverse-motion check valve 12*a*, and an auxiliary valve 51*b* arranged in a line 59 connecting the main line 5 and the reverse-motion check valve 12*b*. Additionally, the fifth embodiment comprises a pair of connecting lines 42 and 43, a directional control valve 1, a hydraulic pump 3, a hydraulic motor 4, a tank 6, a pair of relief valves 9 and 9, a prime mover 44 and the like, which are similar to those of the first embodiment. The aforesaid auxiliary valves 51*a* and 51*b* are arranged similarly to each other. As shown in FIG. 13, each of the auxiliary valves 51*a* and 51*b* comprises, for example, a casing body 54 which has a first opening 52 formed on the side connected to the secondary port of the reverse-motion check valve 12*a* or 12*b* and a second opening 53 formed on the side connected to the main line 8 (5), a piston 55 so arranged as to be movable in the housing body 54, an orifice such as a small bore 56 through the piston 55 for selectively preventing the hydraulic fluid from flowing from the first opening 52 toward the second opening 53, and a spring 57 biasing the piston 55 toward the first opening 52.

The above-described auxiliary valves 51*a* and 51*b* cooperate with each other to form regulating means for selectively limiting outflow of the hydraulic fluid from the main line 5 or 8 on the fluid return side through the reverse-motion check valves 12*a* and 12*b* when the directional control valve 1 is returned to the neutral position to halt the hydraulic motor 4.

In the fifth embodiment constructed as described above, when the hydraulic excavator is arranged on a slope and the temperature of the hydraulic fluid flowing through the circuit is relatively high such that the environmental temperature is, for example, the normal temperature, since the viscosity of the hydraulic fluid is low, the hydraulic fluid in the auxiliary valve 51*a* or the auxiliary valve 51*b* flows into the main line 8 or the main line 5 through the first opening 52, the small bore 56 in the piston 55 and the second opening 53, when the swing 4A is shifted from swinging movement to halt movement. Accordingly, the auxiliary valves 51*a* and 51*b* merely form passages, respectively, and therefore the reverse-motion check valve 12*a* or the reverse-motion check valve 12*b* normally operates. Thus, the reverse motion of the swing 4A can be prevented from occurring.

On the other hand, when the environmental temperature is low under a similarity arranged condition, since the viscosity of the hydraulic fluid increases, flow of the hydraulic fluid tending to pass through the auxiliary valve 51*a* or 51*b* is restricted by the small bore 56 in the piston 55, when the swing 4A is shifted from the swinging movement to the halt movement. Accordingly, the piston 55 is moved toward the first opening 53 against the force of the spring 57, and is abutted against the inner wall surface of the casing body 54. Thus, the piston 55 is prevented from being moved by the inner wall surface. Here, an amount of the hydraulic fluid passing through the small bore 56 is limited depending on its viscosity so that only a small amount of the hydraulic fluid flows into the main line 8 or the main line 5, or the inflow of the hydraulic fluid is prevented. Accordingly, the reverse motion of the swing 4A is restrained during movement of the piston 55, and outflow of the hydraulic fluid from the main line 5 or 8 through the reverse-motion check valves 12*a* and 12*b* is limited or nullified depending on the viscosity of the hydraulic fluid. Thus, scamper of the hydraulic motor 4, that is, abnormal operation can be prevented from occurring.

In the fifth embodiment constructed in this manner, the abnormal operation of the hydraulic motor 4 at the time the hydraulic excavator is arranged on a slope and at low-temperature environment can be prevented from occurring. Thus, there are produced advantages similar to those of the first embodiment.

Figure 14:
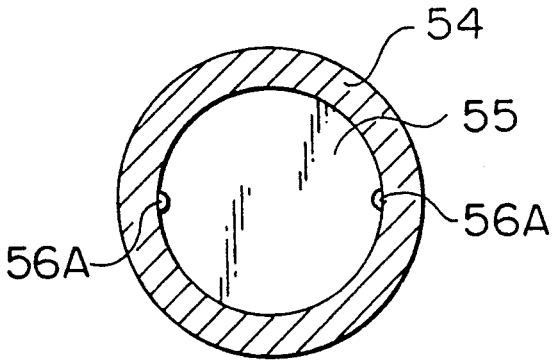
FIG. 14 is a cross-sectional view of an auxiliary valve showing a modification of a pair of orifices provided in the auxiliary valve.

In the fifth embodiment, the small bore 56 is provided in the piston 55. In substitution for the small bore 56, however, as shown in FIG. 14, a pair of gaps 56A and 56A may be defined between the piston 55 and the inner wall of the casing 54. This arrangement can produce advantages similar to those of the fifth embodiment.

SIXTH EMBODIMENT

A sixth embodiment of the invention will be described with reference to FIG. 15.

Figure 15:
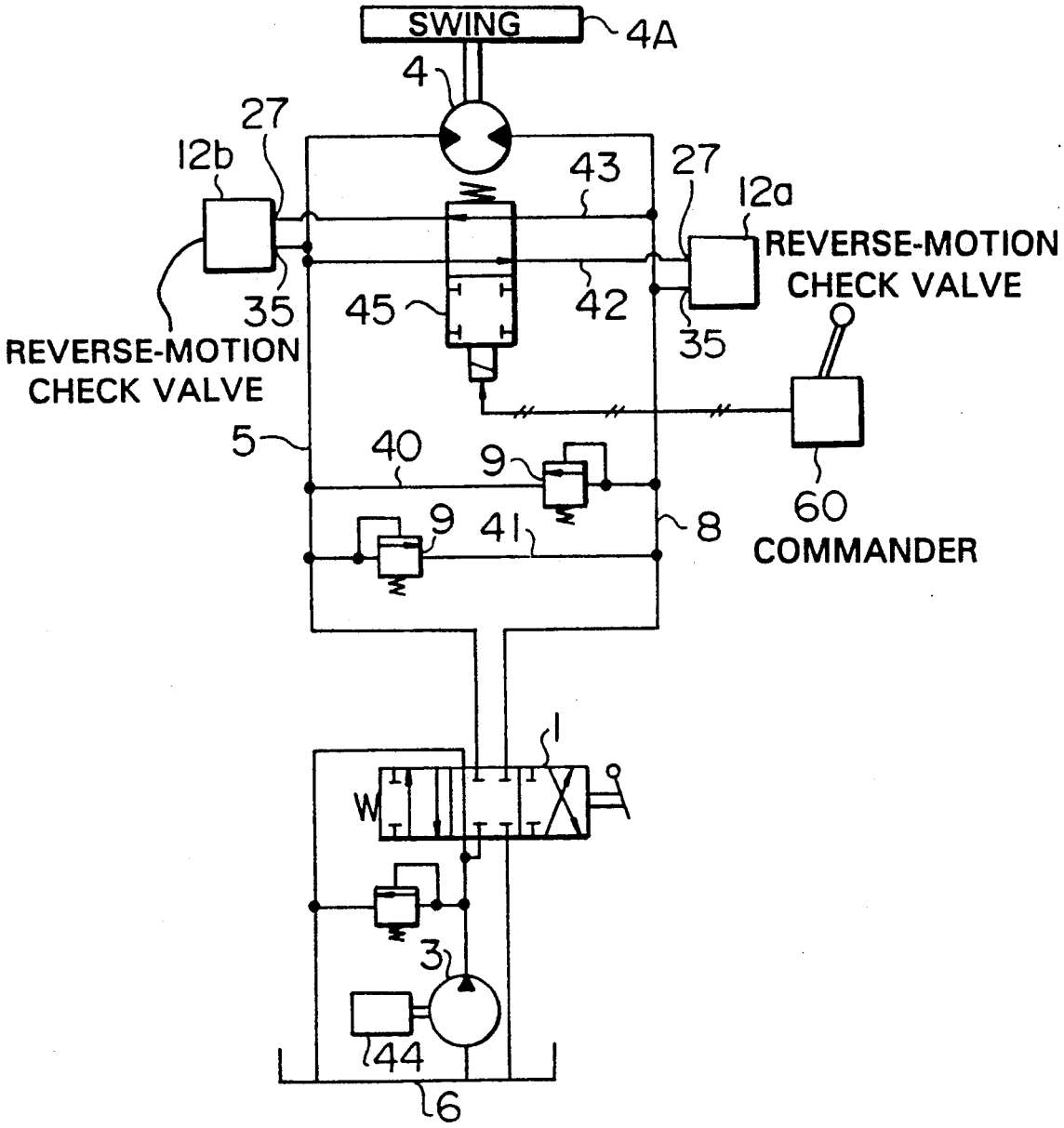
FIG. 15 is a schematic view of a hydraulic drive system for a civil-engineering and construction machine, according to a sixth embodiment of the invention.

The sixth embodiment illustrated in FIG. 15 comprises a commander 60 for outputting an electrical signal to the solenoid selector valve 45 by operation of an operator to turn on the solenoid selector valve 45, that is, to switch the solenoid selector valve 45 to a lower position in FIG. 15. The solenoid selector valve 45 and the commander 60 cooperate with each other to form regulating means for selectively limiting outflow of the hydraulic fluid from the main line 5 or 8 on the fluid return side through the reverse-motion check valves 12*a* and 12*b* when the directional control valve 1 is returned to the neutral position to halt the hydraulic motor 4.

In the sixth embodiment constructed in this manner, in the case where the hydraulic excavator is arranged on a slope and the environmental temperature is low, the operator manipulates the commander 60 to turn on the solenoid selector valve 45. Thus, abnormal operation of the hydraulic motor 4 at the time of halt from swinging can be prevented from occurring. Accordingly, reduction of working efficiency due to the abnormal operation of the hydraulic motor 4 can be prevented, and safety can be ensured so that operability is improved.

INDUSTRIAL APPLICABILITY

According to the invention, in the hydraulic drive system for the civil-engineering and construction machine, comprising the reverse-motion check valve means, the regulating means selectively limits outflow of the hydraulic fluid through the reverse-motion check valve means at low-temperature environment and when the civil-engineering and construction machine is arranged on a slope to conduct operation. Thus, it is ensured that the actuator is halted, accompanied with no abnormal operation. For this reason, working efficiency is prevented from being reduced and safety is ensured to improve operability.

What is claimed is:

1. A hydraulic drive system for a civil-engineering and construction machine, comprising a hydraulic-fluid source, an actuator operated by hydraulic fluid supplied from said hydraulic-fluid source for driving an inertial body, a directional control valve for controlling flow of the hydraulic fluid supplied from said hydraulic-fluid source to said actuator, a pair of main lines through which said directional control valve and said actuator are connected to each other, said pair or main lines functioning selectively as a main line on a fluid supply side and a main line on a fluid return side by operation of said directional control valve, and reverse-motion check valve means connected to said main lines, said reverse-motion check valve means being brought temporarily to an open position under a restricting action of a damping small bore immediately after halt of said actuator to cause hydraulic fluid of high pressure to flow out from said main line on the fluid return side, thereby preventing a reverse motion of said inertial body, wherein regulating means is provided for selectively limiting overflow of the hydraulic fluid from the main line on the fluid return side through said reverse-motion check valve means, when said directional control valve is returned to a neutral position to halt said actuator; and wherein said regulating means includes auxiliary valve means arranged in a line through which said reverse-motion check valve means and the main line on the fluid supply side are connected to each other, for limiting flow of the hydraulic fluid below a predetermined amount depending on a viscosity of the hydraulic fluid.

2. A hydraulic drive system for a civil-engineering and construction machine, comprising a hydraulic-fluid source;

an actuator operated by hydraulic fluid supplied from said hydraulic-fluid source for driving an inertial body;

a directional control valve for controlling flow of the hydraulic fluid supplied from said hydraulic-fluid source to said actuator, said directional control valve having a neutral position;

a pair of main lines through which said directional control valve and said actuator are connected to each other;

said pair of main lines functioning selectively as a main line on a fluid supply side and a main line on a fluid return side by operation of said directional control valve;

first and second connecting lines each bridging said pair of main lines for communication with each other; and first and second reverse-motion check valves disposed in said first and second connecting lines, respectively, said first and second reverse-motion check valves each having a damping small bore operative to close when the pressure in said main line on the fluid return side is lower than the pressure in said main line on the fluid supply side during normal operation of said actuator and when the pressure in said main line on the fluid return side is higher than the pressure in said main line on the fluid supply side during braking of said actuator just after returning of said directional control valve to the neutral position, respectively, while also being operative to temporarily open due to an action of restriction by said damping small bore when the pressure in said main line on the fluid return side is reduced to a predetermined level upon completion of the braking of said actuator after lapse of a predetermined time after returning of said directional control valve to the neutral position, wherein said main line on the fluid return side is brought into communication with the main line on the fluid supply side for preventing a reverse motion of said inertial body and wherein the hydraulic drive system further includes:

additional valve means disposed in said first and second connecting lines in series with respect to said first and second reverse-motion check valves, respectively, for controlling opening and closing of said first and second connecting lines; and command means for selectively operating said additional valve means to close said first and second connecting lines at least upon completion of the braking of said actuator thereby to prevent an excess operation of said actuator which otherwise might occur when said first and second reverse-motion check valves are opened.

3. A hydraulic drive system for a civil-engineering and construction machine according to claim 2, wherein said additional valve means comprises a single solenoid selector valve.

4. A hydraulic drive system for a civil-engineering and construction machine, according to claim 3, wherein said command means comprises a fluid temperature sensor for detecting a temperature of the hydraulic fluid supplied to said actuator, and control means for judging whether or not a signal value outputted from said fluid temperature sensor is lower than a set temperature stored beforehand, and outputting a drive signal for switching said solenoid selector valve to a cutoff position when it is judged that said signal value is lower than the set temperature.

5. A hydraulic drive system for a civil-engineering and construction machine, according to claim 3, further comprising a prime mover driving said hydraulic-fluid source, wherein said command means comprises a water temperature sensor for detecting a temperature of cooling water in said prime mover, and control means for judging whether or not a signal value outputted from said water temperature sensor is lower than a set temperature stored beforehand, and outputting a drive signal for switching said solenoid selector valve to a cutoff position when it is judged that the signal value is lower than the set temperature.

6. A hydraulic drive system for a civil-engineering and construction machine, according to claim 3, wherein said command means comprises operation detecting means for detecting whether or not said directional control valve is returned to the neutral position, and control means for judging whether or not the lapse time after return of said directional control valve to the neutral position exceeds a set time stored beforehand on the basis of a signal outputted from said operation detecting means, and outputting a drive signal for switching said solenoid selector valve to a cutoff position when it is judged that the lapse time exceeds the set time.

7. A hydraulic drive system for a civil-engineering and construction machine, according to claim 3, wherein said command means comprises an inclined-angle sensor for detecting an inclined angle of the civil-engineering and construction machine on which the hydraulic drive system is installed, and control means for judging whether or not a signal value outputted from said inclined-angle sensor is larger than a set angle stored beforehand, and outputting a drive signal for switching said solenoid selector valve to a cutoff position when it is judged that the signal value is larger than the set angle.

8. A hydraulic drive system for a civil-engineering and construction machine, according to claim 3, wherein said command means includes a commander manipulated by an operator for generating an electrical signal for switching said solenoid selector valve to a cutoff position.

9. A hydraulic drive system for a civil-engineering and construction machine, according to claim 1, wherein said auxiliary valve means comprises a casing body having a first port connected to said reverse-motion check valve means and a second port connected to the main line on the fluid supply side, a piston movably arranged in said casing body, an orifice for limiting flow of the hydraulic fluid from said first port toward said second port to bias said piston toward said second port, and a spring for biasing said piston toward said first port.

10. A hydraulic drive system for a civil-engineering and construction machine, according to claim 9, wherein said orifice is a small bore formed through said piston.

11. A hydraulic drive system for a civil-engineering and construction machine, according to claim 9, wherein said orifice is a gap defined between an outer periphery of said piston and an inner peripheral wall of said casing body.

* * * * *